US005855710A

United States Patent [19]

Hinton

[11] Patent Number: 5,855,710

[45] Date of Patent: Jan. 5, 1999

[54] METHOD AND APPARATUS FOR LABELING CONTAINERS

[75] Inventor: Gaylen Roy Hinton, Merced, Calif.

[73] Assignee: Trine Labeling Systems, Turlock, Calif.

[21] Appl. No.: 745,820

[22] Filed: Nov. 12, 1996

[51] Int. Cl.[6] ..... B65C 9/00

[52] U.S. Cl. ..... 156/86; 156/215; 156/446; 156/448; 156/566

[58] Field of Search ..... 156/446, 447, 156/448, 449, 566, 567, 568, DIG. 31, DIG. 38, 86, 215, 456

[56] References Cited

U.S. PATENT DOCUMENTS

| | | | |
|---|---|---|---|
| 4,145,040 | 3/1979 | Huber | 271/276 |
| 4,786,046 | 11/1988 | Freeman et al. . | |
| 4,838,982 | 6/1989 | Klaeser et al. | 156/520 |
| 5,275,678 | 1/1994 | West et al. . | |
| 5,344,519 | 9/1994 | Galchefski et al. | 156/DIG. 38 X |

FOREIGN PATENT DOCUMENTS

| | | |
|---|---|---|
| 0 241 709 A1 | 10/1987 | European Pat. Off. . |
| 0 559 005 A1 | 9/1993 | European Pat. Off. . |
| 2 187 163 A | 3/1987 | United Kingdom . |

OTHER PUBLICATIONS

Copy of PCT International Search Report corresponding to International Application No. PCT/US97/20242.

Copy of Abstract JP 06 099961A, Dec. 4, 1994.

*Primary Examiner*—James Engel
*Attorney, Agent, or Firm*—Morgan & Finnegan, L.L.P.

[57] ABSTRACT

A method and apparatus for labeling containers allows labeling of containers by wrap around labeling without applying an adhesive on the leading edge of the label. Labels are held on a label drum and moved into a label applying position while containers are fed into the label applying position. Air is blown from the label drum onto the leading edge of the label at an angle to the label drum surface and in a direction backward along the label from the leading edge to force the leading edge of the label against the container. The leading edge is maintained on the container by wet adhesion or by air which is blown onto the label and container from the side opposite the label drum.

51 Claims, 9 Drawing Sheets

METHOD AND APPARATUS FOR LABELING CONTAINERS

This application is related to commonly assigned co-pending application entitled An Article Having Label Wrapped Thereon Without Adhesive On Leading Edge, filed on even date hereof by the same inventor.

FIELD OF THE INVENTION

This invention is related to a method and apparatus for labeling containers by wrap-around labeling without having an adhesive on the leading edge of the label.

BACKGROUND OF THE INVENTION

In many parts of the world, recycling is becoming commonplace and even required by law. In recent years, plastic bottles and containers were discarded while glass containers often were recycled or reused. However, even now some regulations in various areas even require plastic containers, such as refillable PET containers, to be recycled or reused.

Many of these PET and similar plastic containers are labeled using a wrap-around labeling process where a leading edge of a label is applied onto the container and secured thereon typically by an adhesive that has been applied onto the leading edge while the label moves with rotating label drum. The container also rotates and draws a label from the label drum. As the container rotates, the label is wrapped about the container and the trailing edge secured by an adhesive either onto the container or overlying the leading edge. If the container has a contoured surface, such as a convex or sloped end portion, a heat shrinkable layer is heat shrunk over the contoured or inclined surface.

When the containers are recycled or reused, the label is stripped from the container. Because the leading edge of the label had been secured by an adhesive onto the container, after the label has been stripped from the container, often a residue of adhesive from the leading edge is retained on the container. This is an undesirable byproduct of that labeling operation.

It would be advantageous if many containers could be labeled and applied by a wrap-around labeling technique without having an adhesive applied onto the leading edge. Additionally, such method and apparatus would be advantageous because it would increase production. Often, a misfed label can create a production "glitch" because an adhesive roller or other means that is used for applying adhesive onto the leading edge of the label would apply adhesive to the surface of the label drum. If this occurs, then an operator often must clean the labeling drum, taking valuable production time and creating greater production costs.

SUMMARY OF THE INVENTION

The present invention is a method and apparatus for labeling a container where a label can be applied onto the container by a wrap around labeling without applying an adhesive onto the leading edge of the label. In accordance with one aspect of the invention, labels are held on a label drum and moved into a label applying position as the label drum is rotated. At the same time, a container to be labeled is fed from a feeding mechanism into the labeling applying position. Air is blown from the label drum onto the leading edge of the label at an angle to the label drum surface and in a direction backward along the label from the leading edge to force the leading edge of the label against the container.

As the container rotates, the label leading edge is maintained against the container. In one aspect of the invention, the leading edge is maintained by wet adhesion. In another aspect, air is blown onto the label and container from the side opposite the label drum to maintain the leading edge of the label against the container while rotating the container so that the label is wrapped about the container. The trailing edge is then secured to the leading edge by an adhesive applied onto the trailing edge.

In another aspect of the present invention, the container is engaged against a stationery roll-on pad spaced from the label drum so that the container is rotated between the label drum and the stationary roll-on pad. Air is then blown from the roll-on pad onto the label as the leading edge of the label moves into a position adjacent the roll-on pad. The laminar flow of air under the label can be minimized by blowing air from the roll-on pad in both the straight and inclined direction from orifices positioned in the roll-on pad. It is important to reduce the laminar flow of air under the label. Any laminar flow of air under the label creates a Bernoulli Effect, which makes a low pressure under the label, sucking the label tighter against the vacuum drum. Additionally, the laminar flow of air under the label can be minimized by blowing the air from the roll-on pad over a slot formed in the roll-on pad.

Additionally, any laminar flow of air under the label can be minimized as it is blown from the label drum by blowing the air over a slot formed in the label drum.

The label drum can use a solenoid or manifold system to first draw a vacuum on the label as it moves into a label applying position to maintain the label on the drum. After the leading edge has moved into the labeling applying position, the vacuum is terminated and the leading edge is blown outward by air forced through orifices formed on the surface of the label drum.

The adhesive can be applied onto the trailing edge of the label or applied on a portion of the label extending from the trailing edge and across the label to the medial portion of the label or even to an area adjacent the leading edge of the label. Additionally, if the article has a contoured surface, the container can be moved into a heat shrink oven which shrinks a heat shrinkable label onto the contoured section of the container.

DESCRIPTION OF THE DRAWINGS

The foregoing and other objects and advantages of the present invention will appreciated more fully from the following description, with references to the accompanying drawings in which.

DETAILED DESCRIPTION OF THE INVENTION

Figure 1:
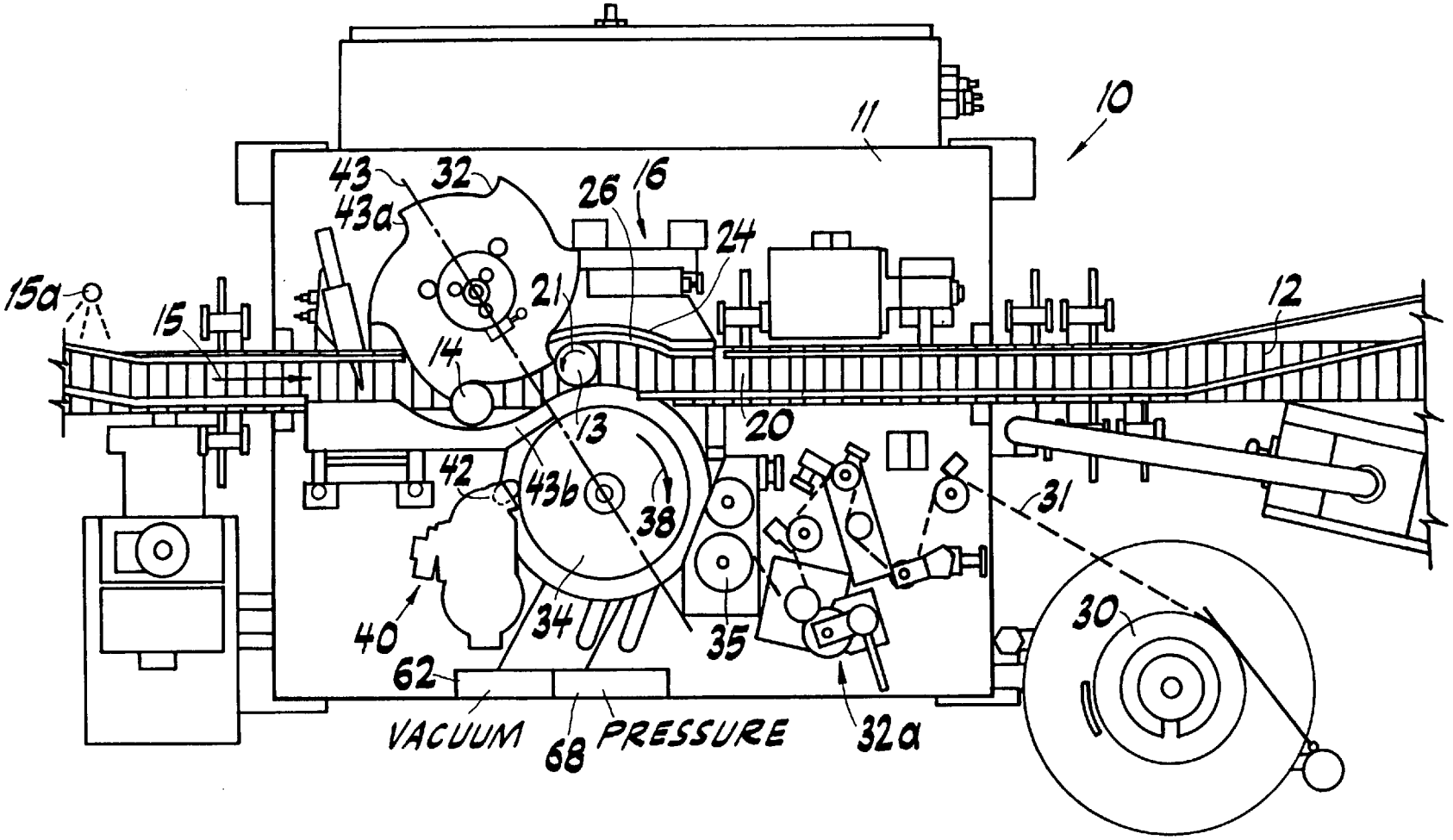
FIG. 1 is a plan view of a labeling machine characterizing features of the present invention.

In accordance with the present invention, containers can now be labeled by a wrap-around labeling process without having an adhesive applied onto the leading edge of a label. The process uses a labeling machine as illustrated in FIG. 1 which shows a general schematic plan view of a labeling machine mounted on a mounting surface or generally flat table top 11. Such labeling machine 10 can be a series 4500 or 6500/6700 manufactured by Trine/CMS Gilbreth Packaging Systems, Inc. of Turlock, Calif.

The containers are labeled by the improved method and apparatus as explained below where the air is blown from a label drum onto the leading edge of a label at an angle to the label drum surface and in a direction backward along the label from the leading edge to force the leading edge of the label against the container. The air is blown at an angle from the drum surface to ensure that the air is blown substantially toward the center of the container. This blown air forces the label to follow the container as it rotates. If the blow-off was straight as in prior art systems, then the label may initially transfer onto the container, but the leading edge of the label would not be held onto the container as the container rotates through its first one-half rotation after meeting the leading edge of the label.

The leading edge of the label is also maintained on the container while rotating through the last one-half rotation until the trailing edge is bonded to the leading edge. This maintaining of the leading edge onto the container can be accomplished by wet adhesion, where the attractive forces, such as induced by capillary action, holds the leading edge of the label against the container. The liquid could initially be contained on the container through the natural condensation experienced in some production plants, or could be deliberately added during delivery of the containers to the label drum.

The leading edge of the label can be maintained against the container by blowing air onto the label and container at an angle from the side opposite the label drum to maintain the leading edge of the label against the container while the container rotates. Typically, the air is blown at an angle from a roll-on pad spaced from the label drum.

As the container is fed, it is rotated between the label drum and a stationary roll-on pad. Air is again blown at an angle to the surface of the roll-on pad to ensure that the air is blown substantially toward the center of the container, which forces the label to follow the container as it finishes the wrap.

Additionally, the-blown air has a tendency to flow in a laminar fashion under the label at either the label drum or the roll-on pad. This laminar flow of air under the label creates a Bernoulli Effect, causing higher air pressure on top of the label and a biasing effect on the label toward the label drum or toward the surface of the roll-on pad. The laminar flow of air under the label can be minimized by flowing the air over a notch or slot formed in the surface of the label surface or the surface of roll-on pad. If the surface of the roll-on pad is rough, air can be directed at an angle and also straight-off from the pad to create turbulence and minimize the flow of air under the label.

There will now be described in greater detail an embodiment of the machine and method of the invention.

A link belt conveyor 12 moves containers or product packages 13, 14 toward the labeling machine 10 in the direction of arrow 15. The labeling machine 10 is designed to apply labels to containers that have a broad range of sizes, or diameters for cylindrical containers. Among this spectrum of container sizes that the labeling machine 10 can process is a mid size container such as a sixteen ounce container that is intermediate between the maximum and minimum container sizes that the machine 10 will label. The machine can label other container sizes such as two or three liter or even smaller size six ounce containers. Sometimes the containers can be filled and capped before labeling. The container can be dry or wetted. Thin layer labels would adhere to the container if the container had a thin layer of water or other liquid even sometimes without air blown from a side opposing the label drum. Water could be from condensation or optional water spray 15*a*.

Containers on the conveyor 12 are first received in the labeling machine 10 by a star wheel assembly 32. The containers 13, 14 may have a thin layer of water such as from condensation by soaking, spraying immersion or other means, although the practice of the invention does not necessitate a water layer. The star wheel assembly 32 moves containers 13, 14 in the direction of the arrow 15 toward a roll-on pad assembly 16. In cycling the containers 13, 14 through the labeling process, the star wheel assembly 32 brings the containers past the roll-on pad assembly 16, which imparts a counter-clockwise rotation to these containers in the direction of the arrow 21. The roll-on pad assembly 16 generally has an arcuate guide 24 that is covered with resilient padding 26 formed from silicone, urethane, rubber or similar material. The resilient padding 26 grips the containers and forces them to rotate in the desired direction.

As shown in FIG. 1, a roll of labels 30 provides a web 31 of labels that is drawn through a feed roller system 32*a* to a cutter 35, which could be a cutter drum (not shown in detail). In accordance with another aspect of the invention, the cutter 35 is placed close to the cylindrical label drum 34 that has a perforated surface containing orifices through which vacuum and pressure are drawn and expelled to retain a label thereto and later blow the leading edge into engagement with a container. Vacuum and pressure can be drawn and expelled by using various port or solenoid valve systems. However, after many cycles, typically solenoids become inoperable. A more efficient apparatus uses manifolds on a hub such as the type disclosed in U.S. Pat. No. 5,344,519 to Galchefski, et al., the disclosure which is hereby incorporated by reference in its entirety.

The web is drawn through the feed roller system 32*a* and pressed against the cutter 35 having a vacuum drawn within the cutter. The cutter rotates and a cutter blade (not shown), protruding from the cylindrical surface of the cutter, presses against the web to cut the web into individual labels "L", having respective leading and trailing edges 27, 28.

Several labels (not shown in FIG. 1) are retained on the label drum 34 and rotated in the direction of arrow 38 on the label drum 34 to an adhesive applicator 40, which includes a glue roller 42. Adhesive can be applied to the surface of the label that is exposed on the label drum by the glue roller 42, and in accordance with the present invention, applied onto the trailing edge of the label. The label drum 34 rotates the leading edge of the label to a point where the leading edge of the label is approximately in alignment with a line 43 between the rotational axis of the drum and the star wheel assembly. As illustrated, the line 43 also coincides with the termination of an arcuate feed guide 43*b*.

The container is pushed by a cusp 43*a* of the star wheel 32 until air blow causes the the leading edge of the label to be engaged to the container and the label wraps itself around the container. The container continues its counter-clockwise rotation as indicated by the arrow 21.

Figure 2:
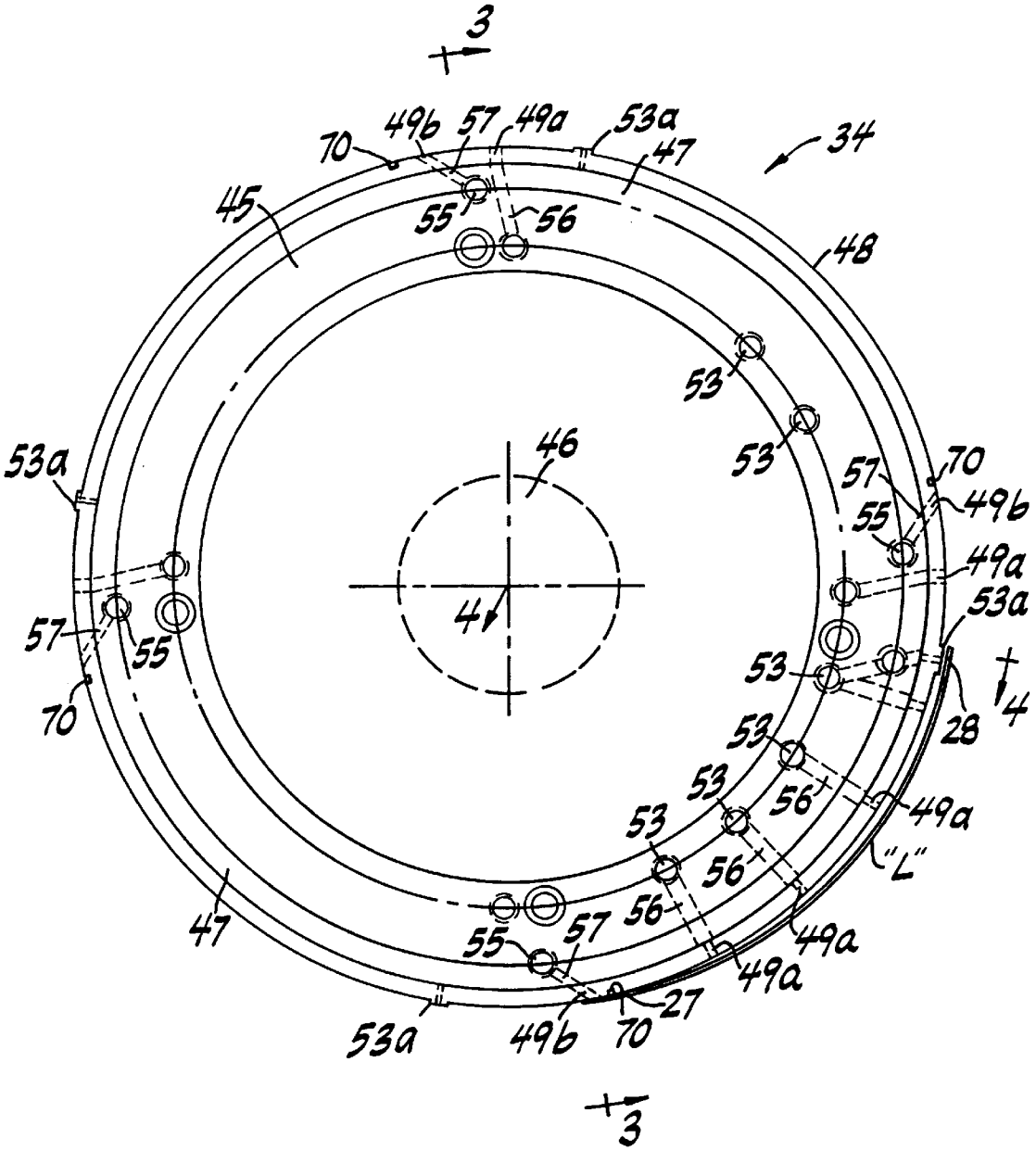
FIG. 2 is a schematic, sectional view of a label drum showing the configuration of the various pressure and vacuum ports.
Figure 3:
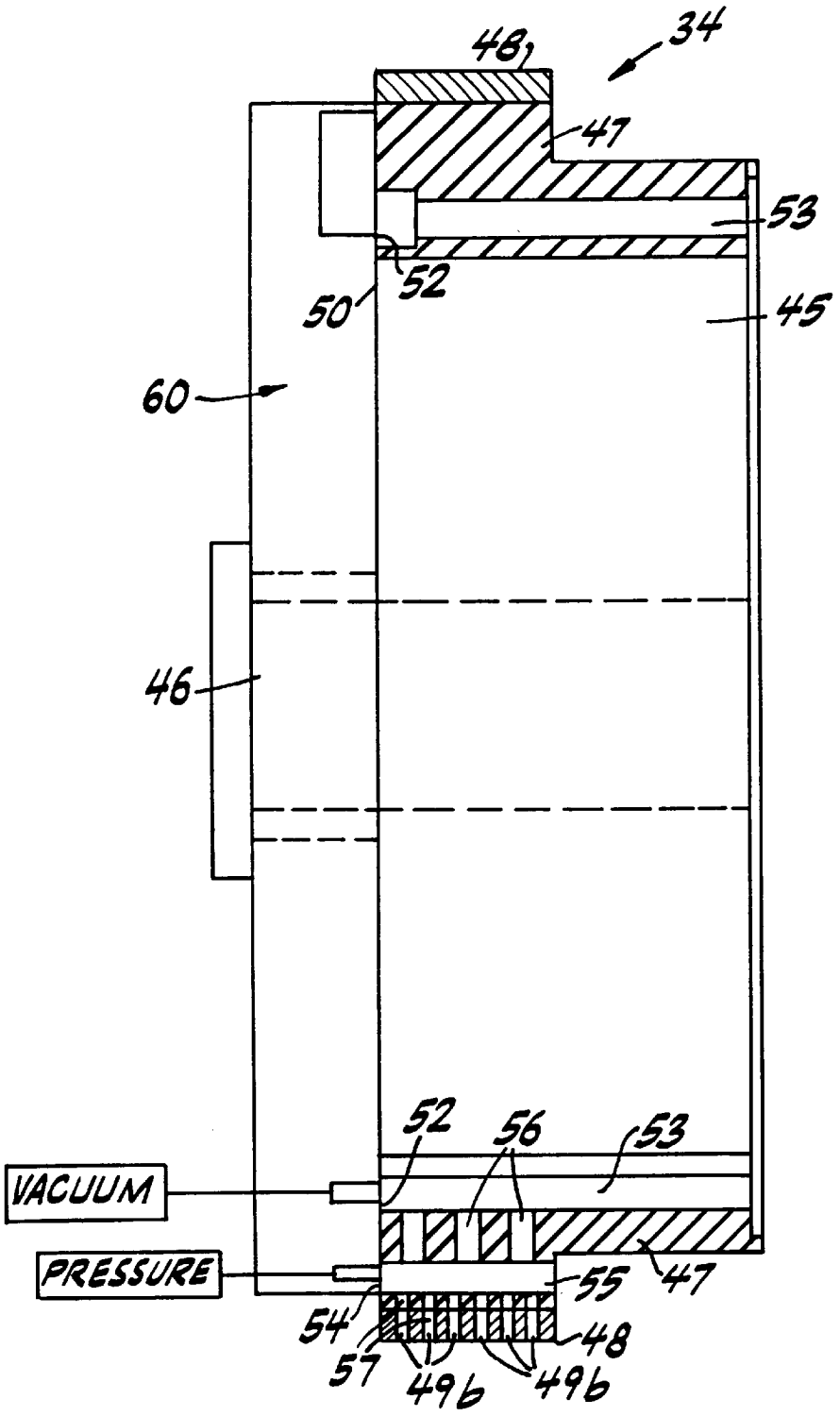
FIG. 3 is a schematic sectional view of the label drum taken along line 3—3 of FIG. 2 and showing a hub rotatably secured to the label drum which allows vacuum and pressure porting.

As shown in FIGS. 2 and 3, the label drum 34 includes a rotatable outer drum member 45, which is rotatably mounted on a hub 46. The drum member 45 includes an outer support surface 47 having a rubber, polyurethane or other resilient material mounted on the outer support surface to form a smooth surface 48 on which the labels rest. Thus, the labels "L" are not damaged by the high speed operation of the machine. Air and vacuum are drawn or expelled though orifices 49*a*, 49*b*, which are formed on the surface 48. The orifices 49*a*, 49*b* are positioned in an area of the surface 48 on which a label is held.

The rotatable drum member 45 is rotatably mounted to the hub 46, which is secured to a machine frame (not shown). The rotatable drum member 45 includes a side flange surface 50 having an inner set of port openings 52 communicating via a manifold 53 with orifices 49*a* on the surface 48 where the trailing edge 28 of a label is positioned. That portion of the label drum surface where the trailing edge 28 of the label lies is partially raised to form a protrusion 53*a* which raises the trailing edge of the label slightly to contact the adhesive roller 42. An outer set of port openings 54 communicate via a manifold 55 with the orifices 49*b* on the surface 48 where the leading edge 27 of a label lies. Each manifold 55, 53 communicates via respective air channels 56, 57 to the respective trailing edge and leading edge sets of orifices 49*a*, 49*b*.

The hub 46 has secured thereto a fixed vacuum drum flange 60 (FIG. 5), which has a circumferentially extending trailing edge vacuum manifold 61 aligned with the inner port openings 52. A source of vacuum 62 is connected to the trailing edge vacuum manifold 61 and draws a vacuum within the manifold, the air channel 57 and through orifices 49*a* in order to draw a vacuum on the area under the trailing edge of the label to retain a label on the label drum as the drum member 45 rotates about its axis and against the fixed vacuum drum flange 60.

Figure 5:
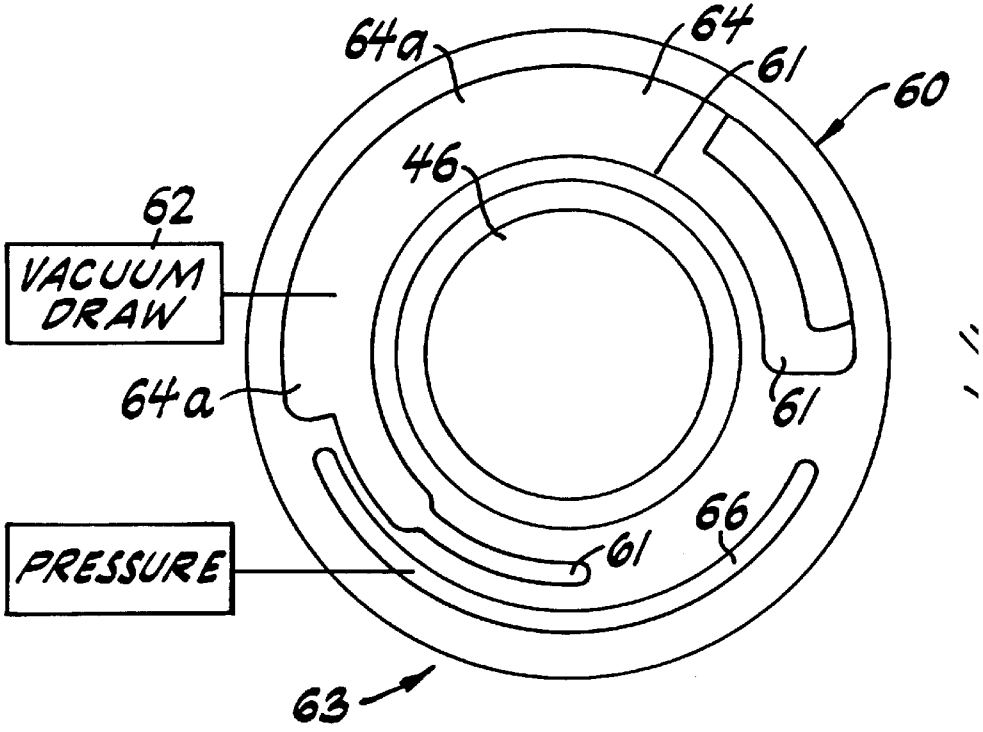
FIG. 5 is a schematic, sectional view of the hub showing various vacuum and pressure ports.
Figure 4:
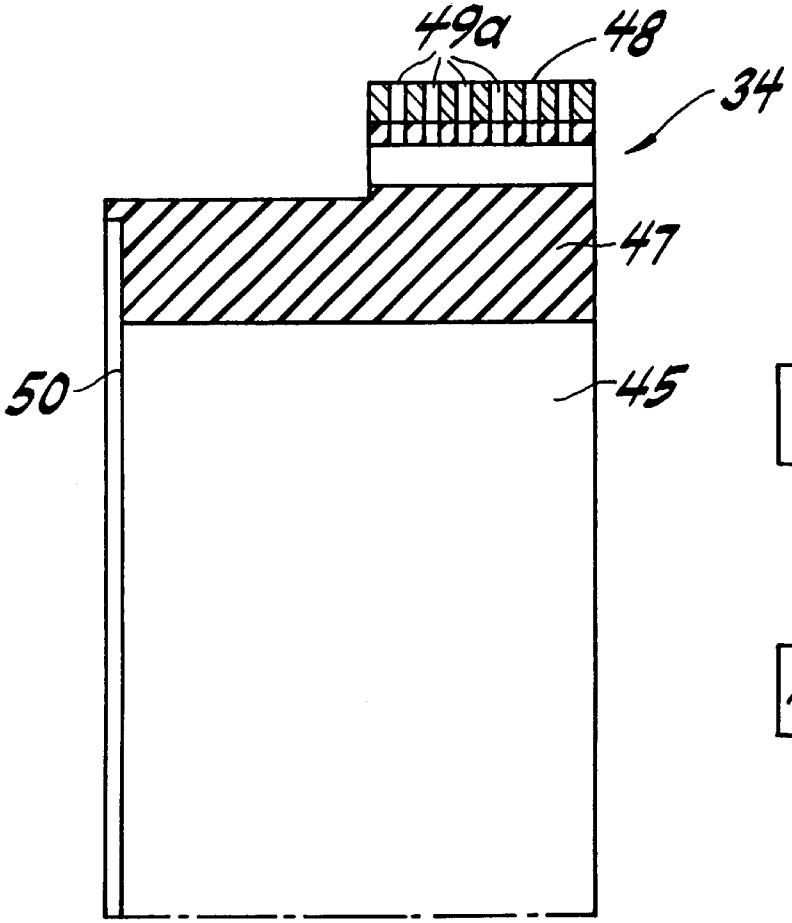
FIG. 4 is a partial, schematic sectional view of the label drum taken along line 4—4 of FIG. 2.

As shown in FIG. 5, the trailing edge vacuum manifold 61 extends circumferentially to a point where vacuum is maintained on a trailing edge 28 of the label until the label is completely wrapped around the container. The trailing edge vacuum manifold 61 also includes a larger or widened portion 64 to form a first leading edge vacuum manifold 64*a* that is aligned with outer port openings 54, and leads to the manifold 55, air channel 57, and orifices 49*b*. Initially, vacuum source 62 draws a vacuum within both sets of port openings for retaining both the trailing edge 28 and leading edge 27 to the drum surface as the label moves into a label wrapping position 63. A leading edge pressure manifold 66 is aligned with the outer port openings 54 and extends after the leading edge vacuum manifold 64*a* to a point where air pressure is applied by a source of air pressure 68.

When the outer drum member 45 has rotated so that the leading edge of the label approaches the label applying position 63, the outer port opening 54 align adjacent the pressure manifold 66, terminating the vacuum draw but blowing the air through orifices 49*b*. As shown in FIG. 2, the leading edge orifices 49*b* extend into the label drum surface and are angled relative to that surface 48 so that the air is blown out of the orifices 49*b* at an angle as described before. The trailing edge orifices, on the other hand, extend straight into the surface 48 to the manifold 53.

Figure 6:
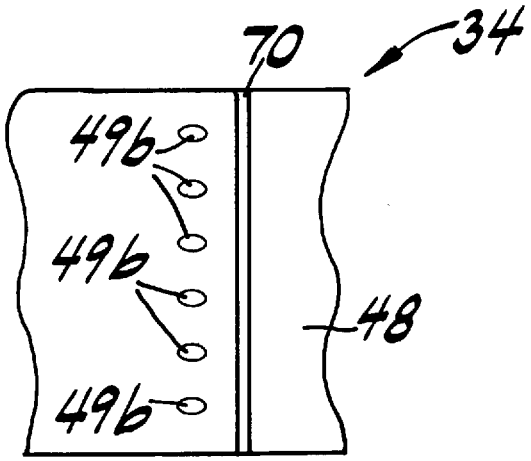
FIG. 6 is a plan view of a portion of the label drum surface showing the angled orifices and the slot adjacent the orifices for minimizing laminar flow of an under the label.
Figure 7:
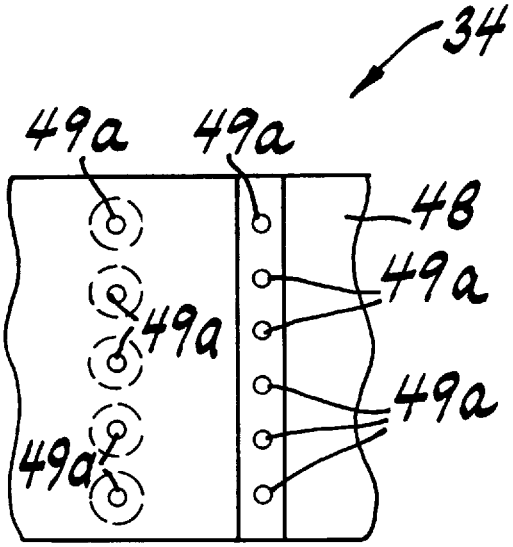
FIG. 7 is another plan view of a portion of the label drum surface showing vacuum ports.
Figure 8:
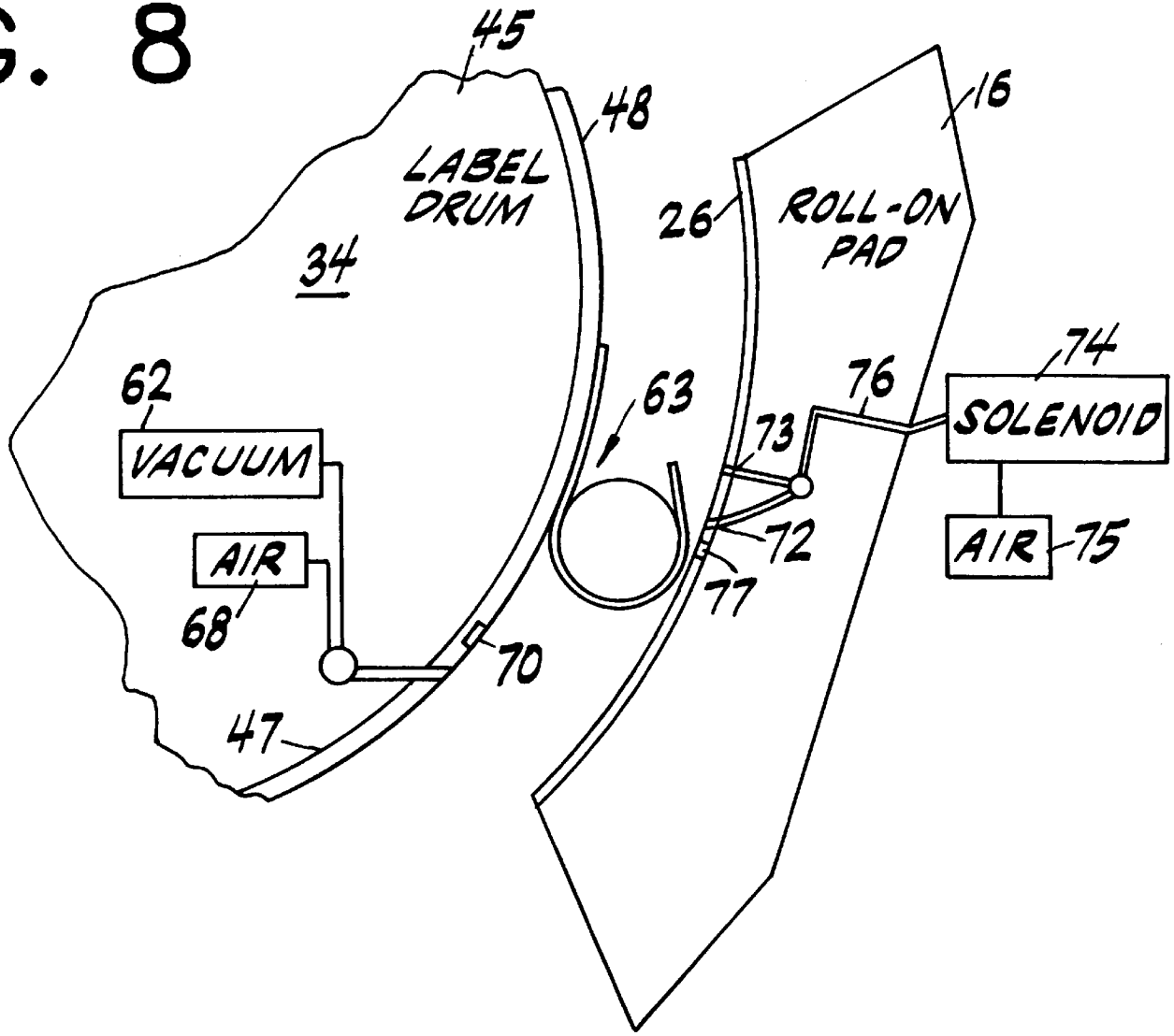
FIG. 8 is a schematic view showing a partially wrapped container fed between the roll-on pad and label drum.

When the label drum 34 rotates and moves the leading edge 27 of the label "L" into a label applying position 63, air is blown from the orifices 49*b* onto the leading edge of the label at an angle to the label drum surface 48 and in a direction backward along the label from the leading edge to force the leading edge 27 of the label against the container (FIGS. 2 and 8). To minimize the biasing of the label toward the drum surface caused by the laminar flow of air under the label, the air is blown over a slot 70 formed in the drum surface 48 (FIGS. 2, 6 and 8), which minimizes the laminar flow of air and under the label.

Because the orifices are drilled in a rubber, urethane or similar material, the orifices may have an hourglass shape, which could enhance a laminar flow from the orifices 49*b*. The laminar flow causes the air to flow under the label and creates the Bernoulli Effect, causing a higher air pressure on top of the label, and thus biasing the label against the surface of the label drum. This is not a desirable effect because the leading edge of the label will not transfer onto the container. The air flowing over the slot 70 can create turbulence, thus minimizing the laminar flow of air under the label. Also, as the container is rotated between the roll-on pad and label drum (FIG. 8) the angled blow of air from the leading edge orifices 49*b* maintains the leading edge of the label on the container 13 because the air is directed against the center of the container.

As the container rotates further, the leading edge of the label can be maintained on the container by several means, including wet adhesion caused by the capillary action of the water acting as a temporary adhesive, thus retaining the leading edge on the container as the container rotates. Wet adhesion is particularly advantageous with thin layer labels.

Alternatively, air flow from opposite the label drum could be used. A timer causes air to flow from the roll-on pad onto the leading edge at a point when the leading edge is adjacent to the roll-on pad. In the illustrated embodiment of FIG. 8, the air can be forced through two sets of orifices 72, 73. The first set 72 is formed to blow air at an angle toward the container and label, and the second set 73 is formed to blow air straight outward from the roll-on pad 16. The flow of air from the two sets of orifices 72, 73 minimizes the laminar flow of air under the label and minimizes any biasing of the label against the surface of the roll-on pad. If the roll-on pad has a rough surface, then the two channels as illustrated are preferred. If the roll-on pad has a smooth surface, then only one angled set of orifices 72 could be used, and a slot 77 could be formed in the roll-on pad to minimize the laminar flow of air under the label.

Various other means and methods also could be used to minimize the laminar flow under the label near the label drum or the roll-on pad. However the above described techniques have been found useful for reducing the laminar flow of air under the label, thus reducing any biasing of the label toward the label drum or roll-on pad.

Figure 11:
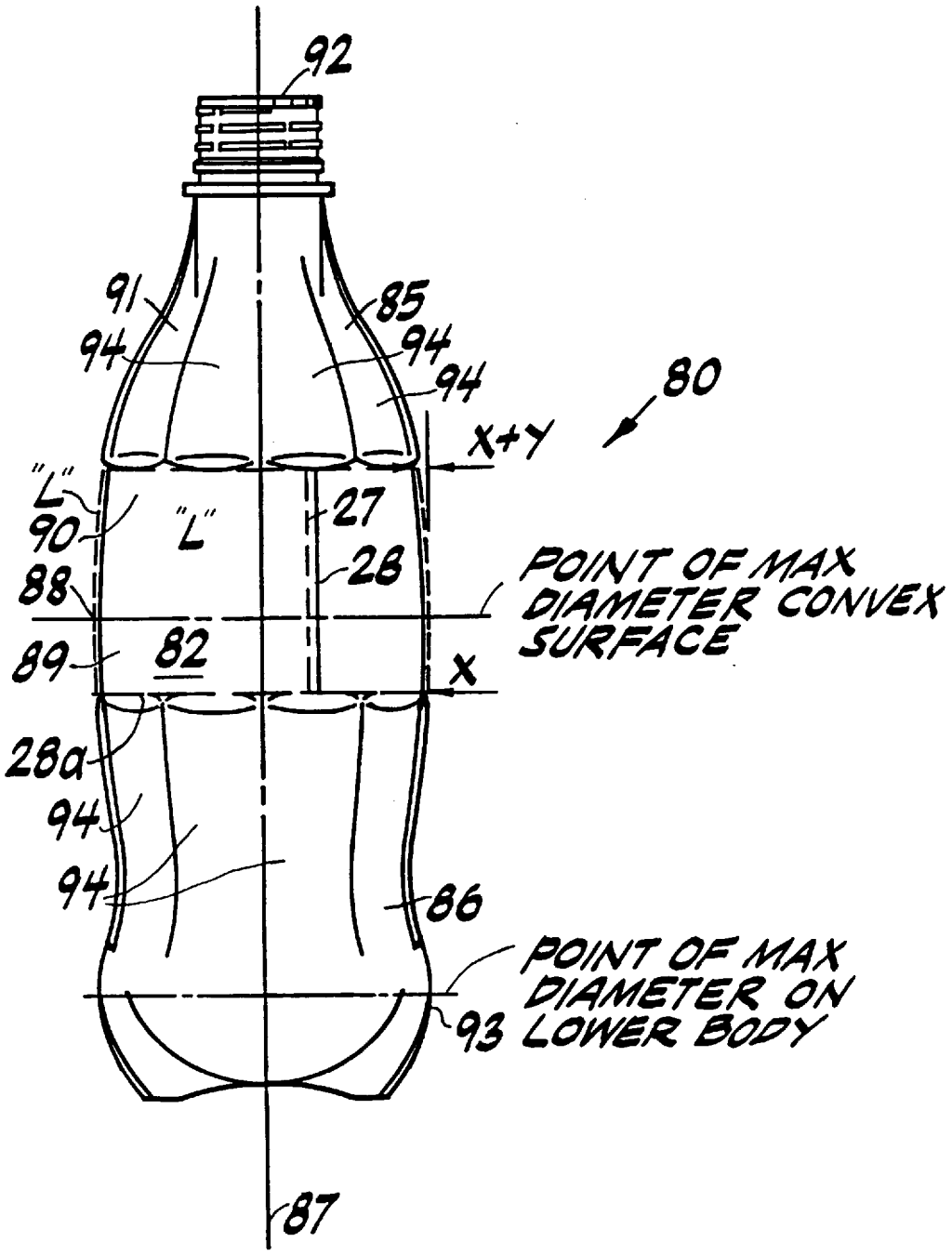
FIG. 11 is an example of a container that can be labeled using the present invention.

Referring now to FIG. 11, there is shown one type of container 80 that can be labeled using the existing method and apparatus as described. This illustrated container has a contoured surface such as the illustrated convex surface 82. Typically, any contoured surface will have a label applied which is heat shrunk over the contoured surface. Examples of contoured surfaces that can be labeled in accordance with the present invention include but are not limited to circular, elliptical, stepped, sloped, concave and convex surfaces. Naturally, a straight-walled container can also be labeled with the method and apparatus of the present invention. Straight-walled containers typically would not require heat shrinking. FIG. 8 illustrates a schematic view of a straight wall container where the surface to be labeled is a straight surface that is parallel to the longitudinally extending axis of the container.

Figure 9:
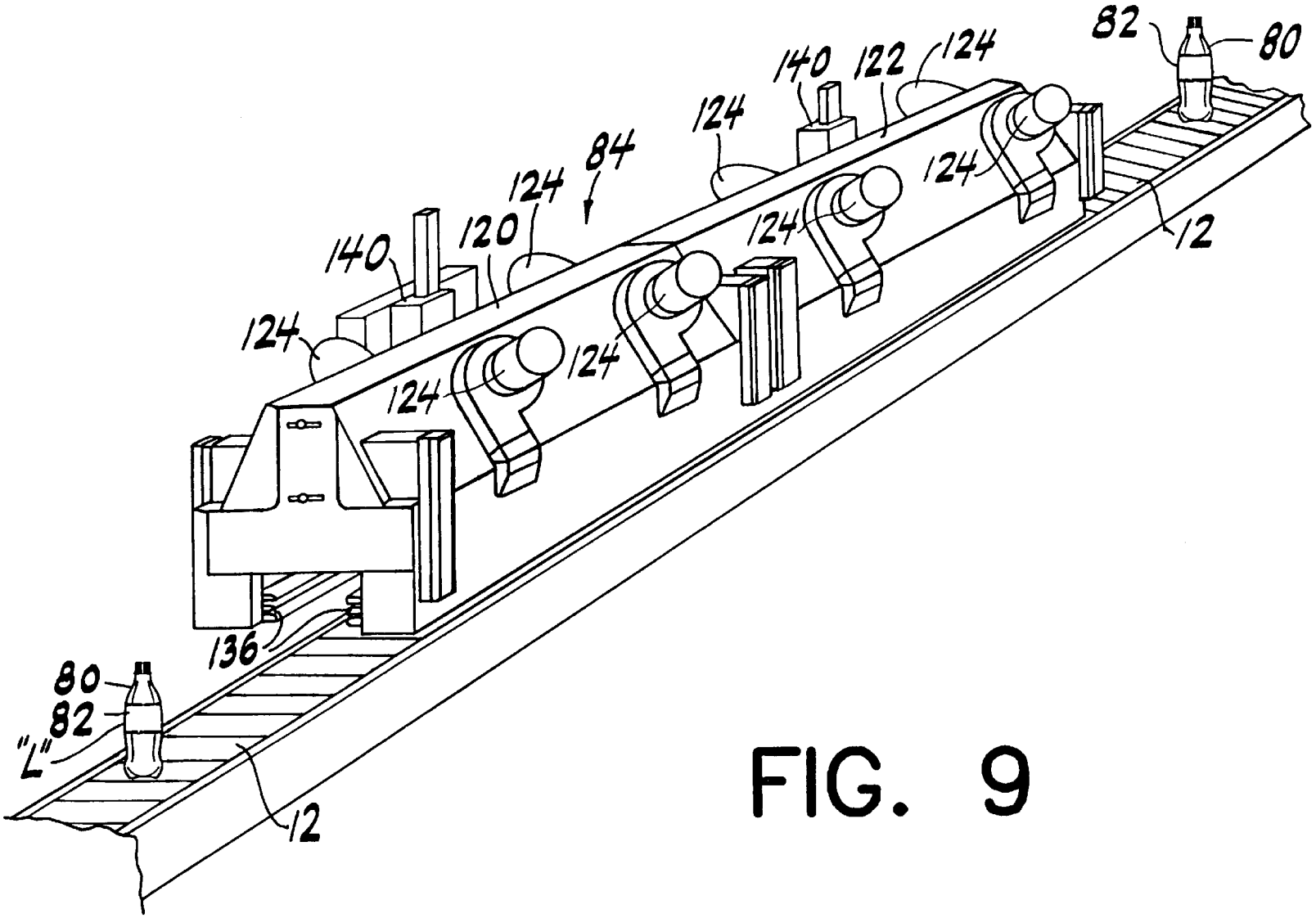
FIG. 9 shows an example of a heat shrink oven that can be used with the present invention.
Figure 10:
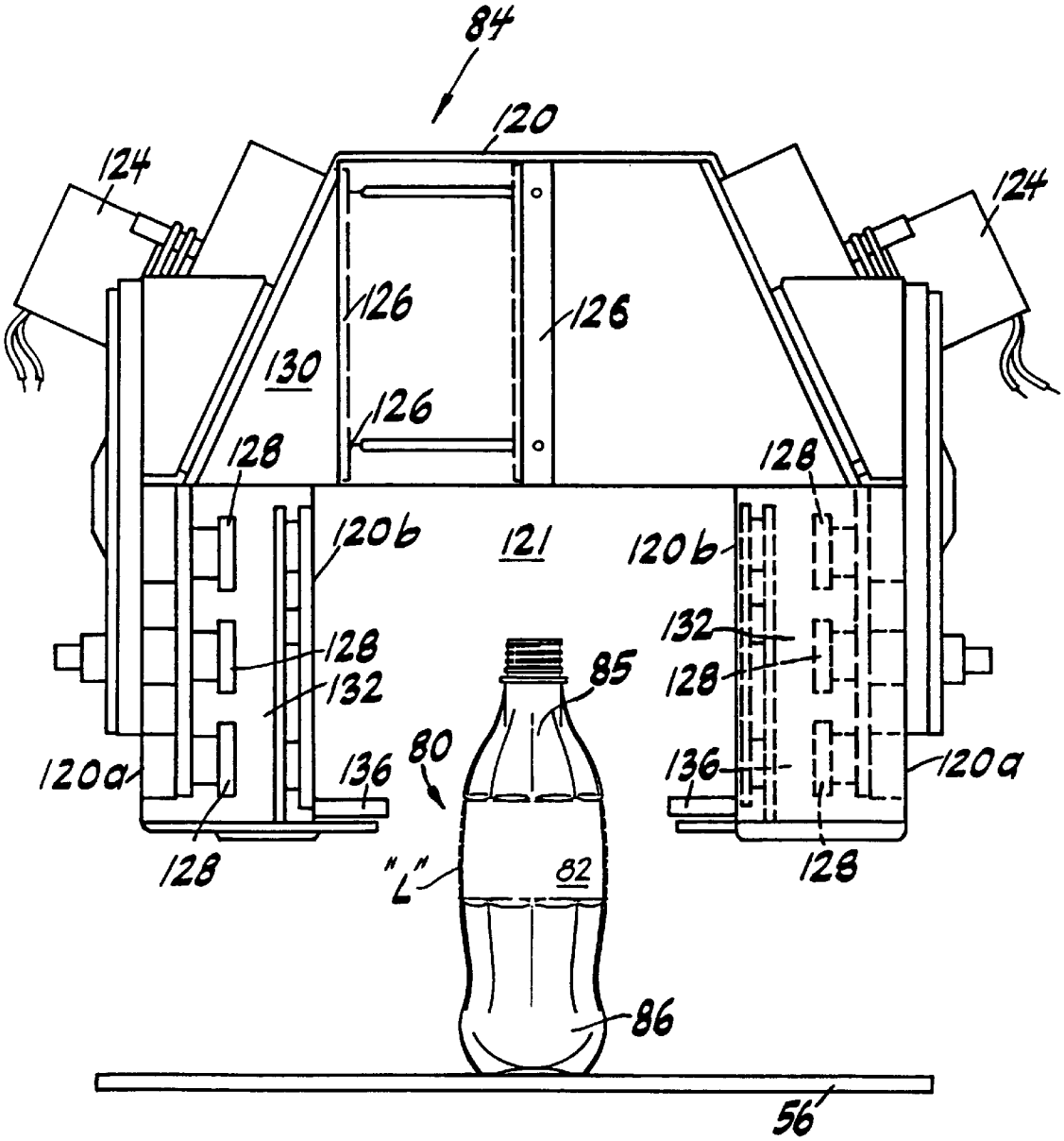
FIG. 10 is another view of a heat shrink oven showing the heat shrinking of a label onto a contoured surface of a container.

Referring to FIGS. 9–11, and more particularly to FIG. 11, there is shown a container 80 entering a heat shrink tunnel, indicated generally at 84. The container exits the tunnel 84 having the label heat shrunk onto its convex surface 82.

The illustrated container 80 includes top and bottom body portions 85, 86, and a central vertical axis 87. The convex surface 82 is located between the top and bottom body portions 85, 86, and presents a sector of maximum diameter 88. The convex surface 82 has a lower convex portion 89 and an upper convex portion 90. The upper convex portion 90 has greater convexity than the convexity of the lower convex portion 89 as shown by the dimension "X plus Y" located between the point of maximum convexity on the upper convex portion and the tangent line. This is compared to the smaller dimension "X" corresponding to the spacing between the tangent line and the point of maximum convexity on the lower convex portion. The upper convex portion 90 has much greater surface area than the lower convex portion 89.

The upper body portion 85 includes a generally arcuate tapering section 91 which terminates in an opening 92 on which a cap could be screwed. The lower body portion 86 includes an area of maximum diameter 93 so that the portion between the convex surface 82 and the area of maximum diameter 93 on the lower body portion is of lesser diameter as shown in FIG. 11. In one embodiment, the maximum diameter is slightly greater than the maximum convex diameter 88. Both the upper and lower body portions 85, 86 are fluted as illustrated generally at 94. The containers 80 typically are formed from a plastic material such as PET or polyethylene, or other material known to those skilled in the art. The containers could be formed from glass.

The labels "L" which are applied onto the convex surface typically are rectangular configured and have respective leading, trailing and side edges 27, 28, 28*a* as shown in FIG. 11. Labels 'L' are formed from a thin film layer material and in the embodiment of the container 80 are heat shrinkable for use with the contoured surface. Typically, the labels are about 0.001 to 0.003 inches thick. The label material could be formed from polyethylene, polypropylene, polyvinylchloride or numerous other types of plastic, heat shrinkable, film material known to those skilled in the art. The label can have printed indicia corresponding to identifying, commercial logos and other information.

After having been labeled by the apparatus described above, the container 80 then continues on the conveyor 12 to the heat shrink tunnel illustrated in FIG. 9 and schematically in FIG. 10. As shown in FIGS. 9 and 10, the heat shrink tunnel 84 is formed from a first heat tunnel portion 120 and a second heat tunnel portion 122. Each heat tunnel portion, 120, 122 is in the present embodiment a forty (40) inch forced air heat tunnel manufactured by CMS Gilbreth Packaging Systems of Trevose, Pa. The tunnel portions 120, 122 are formed of a rugged aluminum construction and each have four energy-efficient blower systems illustrated at 124. One eighty (80) inch oven could also be used instead of two forty (40) inch tunnel portions. Each tunnel includes opposing ends, two opposing sides 120*a*, 122*a*, and two inner walls 120*b*, 120*b*. A heating chamber 121 is formed inside each tunnel (FIG. 10). The container 80 passes through the chamber 121 on the conveyor without spinning. As illustrated, the tunnel portions 120, 122 are placed over top the conveyor and do not engage the conveyor.

Referring to FIG. 10, illustrating an end view of the first heat tunnel portion 120, the tunnel includes an air baffle system 126 and heaters 128 for heating the air drawn in by the blowers 124. The air is forced into a manifold area 130 on the upper part of the tunnel 120 and drawn into the side plenums 132, and outward through an air discharge slot 136 extending longitudinally along the inner wall of the lower portion of the tunnel 120. Because the slot extends along the longitudinal length of the tunnel and is simply a long opening and not a leister jet or fan-shaped nozzle, a less harsh blow of hot air is produced.

Typically, the tunnel portions 120, 122 each have an operating temperature of about up to 500° F. and a width adjustment for blowing air from 0 inches to 8.5 inches. They have a standard height adjustment of about 12 inches. The tunnels 120, 122 are positioned above the conveyor and can be supported by linear actuator stands 140 to allow a width adjustment of about 0 to 8.5 inches and a height adjustment of about 14 inches. Typically, the linear actuator stands can be on a castor assembly include leveling pads. Thus, the tunnels 120, 122 can be positioned and tilted so that the slots 136 can be positioned substantially horizontally in tunnel two 122 or at a gradual incline such as that shown in tunnel one 120.

It is evident that the present invention allows labeling of containers without necessitating an adhesive application on the leading edge of the label. This is advantageous because a label can be stripped from a container without leaving a residue of adhesive on the container, which makes recycling of the container much more efficient and inexpensive. Additionally, because there is no requirement for an adhesive applicator for applying adhesive on the leading edge of a label, during production problems when labels are not fed, an adhesive applicator, would not inadvertently apply adhesive onto the surface of the label drum, requiring as a result production downtime for cleaning the label drum.

It should be understood that the foregoing description of the invention is intended merely to be illustrative thereof, and that other embodiments, modifications, and equivalents may be apparent to those skilled in the art without departing from its spirit.

That which is claimed is:

1. A method for labeling containers, comprising the steps of:

moving labels held on a label drum into a label applying position, feeding a container to be labeled into the label applying position, blowing air from the label drum onto a leading edge of the label at an angle to the label drum surface and in a direction backward along the label from the leading edge to force the leading edge of the label against the container, and maintaining the leading edge of the label against the container without use of adhesive, solvent or water on the leading edge of the label while rotating the container so that the label is wrapped about the container.

2. The method according to claim 1, further comprising the step of securing the trailing edge to the leading edge by an adhesive applied onto the trailing edge.

3. The method according to claim 1, further comprising the step of blowing air from the label drum backward against the label and container to maintain the label against the container surface as the container rotates.

4. A method for labeling containers, comprising the steps of:

moving labels held on a label drum into a label applying position;

feeding a container to be labeled into the label applying position;

blowing air from the label drum onto the leading edge of the label at an angle to the label drum surface and in a direction backward along the label from the leading edge to force the leading edge of the label against the container; and blowing air onto the label and container from the side opposite the label drum to aid in maintaining the leading edge of the label against the container while rotating the container so that the label is wrapped about the container.

5. A method for labeling containers comprising the steps of moving labels held on a label drum into a label applying position, feeding a container to be labeled into the label applying position, blowing air from the label drum onto the leading edge of the label at an angle to the label drum surface and in a direction backward along the label from the leading edge to force the leading edge of the label against the container, and blowing air onto the label and container from the side opposite the label drum to maintain the leading edge of the label against the container while rotating the container so that the label is wrapped about the container.

6. The method according to claim 5, further comprising the step of securing the trailing edge to the leading edge by an adhesive applied onto the trailing edge.

7. The method according to claim 5, further comprising the step of engaging the container against a stationary roll-on pad spaced from the label drum so that the container is rotated between the label drum and stationary roll-on pad, and blowing air from the roll-on pad onto the label as the leading edge of the label moves into a position adjacent the roll-on pad.

8. The method according to claim 7, further comprising the step of blowing the air from the roll-on pad in a manner to minimize the laminar flow of air under the label.

9. The method according to claim 8, further comprising the step of minimizing the laminar flow of air under the label by blowing air form the roll-on pad over a notch cut in the roll-on pad.

10. The method according to claim 8, further comprising the step of minimizing the laminar flow of air under the label by blowing the air in straight and at an angle.

11. The method according to claim 5, further comprising the step of blowing air from the label drum backward against the label and container to maintain the label against the container surface as the container rotates.

12. The method according the claim 5, further comprising the step of timing the air blowing from the side opposite the label drum to start when the leading edge of the label approaches the side opposite the label drum and terminating the air blowing when the label has wrapped substantially about the container.

13. The method according to claim 5, further comprising heat shrinking the label onto the container after the label has wrapped thereon.

14. A method for labeling containers, comprising the steps of:

moving labels held on a label drum into a label applying position, feeding a container to be labeled into the label applying position, blowing air from the label drum onto the leading edge of the label at an angle to the label drum surface and in a direction backward onto the label from the leading edge to force the leading edge of the label against the container while also minimizing the laminar flow of air under the label to prevent the label from biasing against the drum surface, and maintaining the leading edge of the label against the container without use of adhesive, solvent or water on the leading edge of the label while rotating the container so that the label is wrapped about the container.

15. The method according to claim 14, further comprising the step of securing the trailing edge to the leading edge by an adhesive applied onto the trailing edge.

16. The method according to claim 14, further comprising the step of blowing air from the label drum backward against the label and container to maintain the label against the container surface as the container rotates.

17. A method for labeling containers comprising the steps of:

moving labels held on a label drum into a label applying position;

feeding a container to be labeled into the label applying position;

blowing air from the label drum onto the leading edge of the label at an angle to the label drum surface and in a direction backward onto the label from the leading edge to force the leading edge of the label against the container while also minimizing the laminar flow of air under the label to prevent the label from biasing against the drum surface; and blowing air onto the label and container from the side opposite the label drum to aid in maintaining the leading edge of the label against the container while rotating the container so that the label is wrapped about the container.

18. A method for labeling containers comprising the steps of moving labels held on a label drum into a label applying position, feeding a container to be labeled into the label applying position, blowing air from the label drum onto the leading edge to the label at an angle to the label drum surface and in a direction backward onto the label from the leading edge to force the leading edge of the label against the container while also minimizing the laminar flow of air under the label to prevent the label from biasing against the drum surface, and blowing air onto the label and container from the side opposite the label drum to maintain the leading edge of the label against the container while rotating the container so that the label is wrapped about the container.

19. The method according to claim 18, further comprising the step of securing the trailing edge to the leading edge by an adhesive applied onto the trailing edge.

20. The method according to claim 18, further comprising the step of blowing the air over a slot formed in the label drum surface to minimize the laminar flow of air under the label.

21. The method according to claim 18, further comprising the step of blowing air from the side opposite the label drum in a manner to minimize the laminar flow of air under the label.

22. The method according to claim 18, further comprising the step of engaging the container against a stationary roll-on pad spaced from the label drum so that the container is rotated between the label drum and stationary roll-on pad, and blowing air from the roll-on pad onto the label as the leading edge of the label moves into a position adjacent the roll-on pad.

23. The method according to claim 22, further comprising the step of blowing air from the roll-on pad in a manner to minimize the laminar flow of air under the label.

24. The method according to claim 23, further comprising the step of minimizing the laminar flow of air under the label by blowing air from the roll-on pad over a slot formed in the roll-on pad.

25. The method according to claim 23, further comprising the step of blowing air from the roll-on pad at an angle and in a straight direction to the roll-on pad to minimize the laminar flow of air under the label.

26. The method according to claim 18, further comprising the step of blowing air from the label drum backward against the label and container to maintain the label against the container surface as the container rotates.

27. The method according to claim 18, further comprising the step of timing the air blowing from the side opposite the label drum to start when the leading edge of the label approaches the side opposite the label drum and terminating the air blowing when the label has wrapped substantially about the container.

28. The method according to claim 18, further comprising the step of heat shrinking the label onto the container after the label has wrapped thereon.

29. An apparatus for labeling containers, comprising:

a label drum having a surface on which labels having leading and trailing edges are retained, and rotatable for moving labels into a label applying position, a container feed for feeding a container into the label applying position, means for blowing air outward from the label drum onto the leading edge of the label at an angle to the label drum surface and in a direction backward along the label from the leading edge to force the leading edge of the label against the container, and means for maintaining the leading edge of the label against the container without use of adhesive, solvent or water on the leading edge of the label while rotating the container so that label is wrapped about the container.

30. The apparatus according to claim 29, further comprising an adhesive applicator for applying adhesive to the trailing edge of the label for securing the trailing edge to the leading edge when the label wraps about the container and the trailing edge overlaps the leading edge.

31. An apparatus for labeling containers, comprising:

a label drum having a surface on which labels having leading and trailing edges are retained, and rotatable for moving labels into a label applying position;

a container feed for feeding a container into the label applying position;

means for blowing air outward from the label drum onto the leading edge of the label at an angle to the label drum surface and in a direction backward along the label from the leading edge to force the leading edge of the label against the container; and means for blowing air onto the label and container from a position spaced outward from the label drum onto the label to maintain the leading edge of the label against the container while rotating the container so that label is wrapped about the container.

32. An apparatus for labeling containers comprising a label drum having a surface on which labels having leading and trailing edges are retained, and rotatable for moving labels into a label applying position, a container feed for feeding a container into the label applying position, means for blowing air outward from the label drum onto the leading edge of the label at an angle to the label drum surface and in a direction backward along the label from the leading edge to force the leading edge of the label against the container, and means for blowing air onto the label and container from a position spaced outward from the label drum onto the label to maintain the leading edge of the label against the container while rotating the container so that label is wrapped about the container.

33. The apparatus according to claim 32, further comprising an adhesive applicator for applying adhesive to the trailing edge of the label for securing the trailing edge to the leading edge when the label wraps about the container and the trailing edge overlaps the leading edge.

34. The apparatus according to claim 32, further comprising a roll-on pad space d from the label drum for engaging a container and pressing the container against the surface of the label drum, and said spaced air blowing means includes orifices on said roll-on pad through which air is blown onto the label and container.

35. The apparatus according to claim 34 wherein said orifices are configured to blow air in a manner for minimizing the laminar flow of air under the label.

36. The apparatus according to claim 34, further comprising a channel formed in the roll-on pad over which the air blows from the orifices in the roll-on pad for minimizing the laminar flow of air under the label.

37. The apparatus according to claim 32, further comprising means for timing the blowing of air from the position spaced outward from the label drum so that blowing starts when the leading edge of the label has moved into a position substantially opposite the label drum and terminates when the label has substantially wrapped about the container.

38. The apparatus according to claim 32, further comprising a heat shrink oven through which the container passes after labeling for heat shrinking the label onto the container.

39. An apparatus for labeling containers comprising a label drum having a surface on which labels having leading and trailing edges are retained, and rotatable for moving labels into a label applying position, a container feed for feeding a container into the label applying position, means for blowing air outward from the label drum and under the leading edge of the label at an angle to the label drum surface and in a direction backward along the label from the leading edge to force the leading edge of the label against the container, means for minimizing the laminar flow of air blown under the label to prevent the label from biasing against the drum surface, and means for maintaining the leading edge of the label against the container without use of adhesive, solvent or water on the leading edge of the label while rotating the container so that label is wrapped about the container.

40. The apparatus according to claim 39, further comprising an adhesive applicator for applying adhesive to the trailing edge of the label for securing the trailing edge to the leading edge when the label wraps about the container and the trailing edge overlaps the leading edge.

41. An apparatus for labeling containers, comprising:

a label drum having a surface on which labels having leading and trailing edges are retained, and rotatable for moving labels into a label applying position;

a container feed for feeding a container into the label applying position;

means for blowing air outward from the label drum and under the leading edge of the label at an angle to the label drum surface and in a direction backward along the label from the leading edge to force the leading edge of the label against the container;

means for minimizing the laminar flow of air blown under the label to prevent the label from biasing against the drum surface;

means for blowing air onto the label and container from a position spaced outward from the label drum onto the label to maintain the leading edge of the label against the container while rotating the container so that label is wrapped about the container.

42. An apparatus for labeling containers comprising a label drum having a surface on which labels having leading and trailing edges are retained, and rotatable for moving labels into a label applying position, a container feed for feeding a container into the label applying position, means for blowing air outward from the label drum and under the leading edge of the label at an angle to the label drum surface and in a direction backward along the label from the leading edge to force the leading edge of the label against the container, means for minimizing the laminar flow of air blown under the label to prevent the label from biasing against the drum surface, and means for blowing air onto the label and container from a position spaced outward from the label drum onto the label to maintain the leading edge of the label against the container while rotating the container so that label is wrapped about the container.

43. The apparatus according to claim 42 wherein said means for minimizing the laminar flow of air under the label includes a channel formed in the surface of the label drum over which the air flows.

44. The apparatus according to claim 42, further comprising an adhesive applicator for applying adhesive to the trailing edge of the label for securing the trailing edge to the leading edge when the label wraps about the container and the trailing edge overlaps the leading edge.

45. The apparatus according to claim 42, further comprising a roll-on pad spaced from the label drum for engaging a container and pressing the container against the surface of the label drum, and said spaced air blowing means includes orifices on said roll-on pad through which air is blown onto the label and container.

46. The apparatus according to claim 45 wherein said orifices are configured to blow air in a manner for minimizing the laminar flow of air under the label.

47. The apparatus according the claim 45, further comprising a channel formed in the roll-on pad over which the air blows from the orifices in the roll-on pad for minimizing the laminar flow of air under the label.

48. The apparatus according to claim 42 wherein said means for blowing air outward from the label drum includes orifices through which air is blown onto the leading edge of the label when the label is moved onto the label applying position.

49. The apparatus according to claim 42, further comprising means for drawing a vacuum through orifices in the label drum to aid in retaining the label on the label drum until the label drum has rotated and moved the label into the label applying position.

50. The apparatus according to claim 50, further comprising means for timing the blowing of air from a position spaced outward from the label drum so that blowing starts when the leading edge of the label has moved into a position substantially opposite the label drum and terminates when the label has substantially wrapped about the container.

51. The apparatus according to claim 42, further comprising a heat shrink oven through which the container passes after labeling for heat shrinking the label onto the container.

* * * * *